US007588072B2

(12) United States Patent
Watanabe et al.

(10) Patent No.: US 7,588,072 B2
(45) Date of Patent: Sep. 15, 2009

(54) LAMINATED HEAT EXCHANGER

(75) Inventors: Mikio Watanabe, Oyama (JP); Hiroshi Matsubayashi, Oyama (JP)

(73) Assignee: Showa Denko K.K., Tokyo (JP)

( * ) Notice: Subject to any disclaimer, the term of this patent is extended or adjusted under 35 U.S.C. 154(b) by 157 days.

(21) Appl. No.: 11/668,697

(22) Filed: Jan. 30, 2007

(65) Prior Publication Data

US 2007/0175619 A1 Aug. 2, 2007

(30) Foreign Application Priority Data

Jan. 31, 2006 (JP) ..... 2006-021772
Dec. 20, 2006 (JP) ..... 2006-342056

(51) Int. Cl.
*F28D 1/03* (2006.01)
*F28D 7/06* (2006.01)

(52) U.S. Cl. ..... 165/153; 165/176

(58) Field of Classification Search ..... 165/152, 165/153, 175, 176
See application file for complete search history.

(56) References Cited

U.S. PATENT DOCUMENTS 6,742,572 B2 * 6/2004 Muhammad et al. ..... 165/67
6,863,120 B2 * 3/2005 Hwang et al. ..... 165/153
2001/0040027 A1 * 11/2001 Tooyama et al. ..... 165/153
2007/0256820 A1 * 11/2007 Lim et al. ..... 165/153

FOREIGN PATENT DOCUMENTS

JP 8-10764 3/1996

* cited by examiner

*Primary Examiner*—Teresa J Walberg
(74) *Attorney, Agent, or Firm*—Oblon, Spivak, McClelland, Maier & Neustadt, P.C.

(57) ABSTRACT

A circular refrigerant outlet is formed in an endmost flat, hollow member of a laminated heat exchanger. An outlet header is fixed to the endmost flat, hollow member, and an outlet pipe having a circular cross section is connected to an open end of the outlet header. The inside diameter of the refrigerant outlet is 90% to 110% that of the outlet pipe. The outlet header has a first portion having a refrigerant passage hole communicating with the refrigerant outlet. The first portion has a vertical, flat wall portion and two fragmentary, cylindrical wall portions continuous with respective upper and lower edges of the flat wall portion. The curvature radius of the inner surface of the fragmentary, cylindrical wall portion is 35% to 50% the inside height of the first portion. The equivalent inside diameter of the first portion is 90% to 110% the inside diameter of the outlet pipe.

10 Claims, 8 Drawing Sheets

LAMINATED HEAT EXCHANGER

BACKGROUND OF THE INVENTION

1. Field of the Invention

The present invention relates to a laminated heat exchanger, and more particularly to a laminated heat exchanger used as an evaporator of a vehicle air conditioner, which is a refrigeration cycle on board a vehicle.

Herein and in the appended claims, the upper, lower, left-hand, and right-hand sides of FIG. 1 will be referred to as "upper," "lower," "left," and "right," respectively. The downstream side of flow (represented by arrow X in FIGS. 1, 2 and 9) of air is referred to as the "front," and the opposite side as the "rear."

2. Description of the Related Art

A known laminated heat exchanger includes a plurality of flat, hollow members arranged in a laminated condition (refer to Japanese Utility Model Publication (kokoku) No. 8-10764). Each of the flat, hollow members includes two vertically elongated metal plates having perimetric edge portions joined together. A bulging refrigerant flow tube portion having a hairpin shape is formed between the two metal plates. A bulging tank formation portion is formed continuously with each of opposite ends of the refrigerant flow tube portion. The tank formation portions of adjacent flat, hollow members are joined together. Clearances between the refrigerant flow tube portions of adjacent flat, hollow members serve as air-passing clearances. An oblong refrigerant outlet extending in a front-rear direction is formed in the outside wall of the tank formation portion of the flat, hollow member located at one end in the left-right direction. An outlet header is fixed to the outer surface of the outside wall of the tank formation portion of the endmost flat, hollow member. The outlet header includes a tubular body extending in the front-rear direction and having opposite end openings, and a closing member for closing one of the end openings of the body. A refrigerant passage hole communicating with the refrigerant outlet is formed in a side wall of the body of the outlet header. An outlet pipe having a circular cross section is connected to an open end portion of the body of the outlet header. The body of the outlet header includes a first portion which is a portion remaining after excluding from the body a portion located on a side toward the end opening and accounts for most of the body and in which the refrigerant passage hole is formed, a second portion which is the open end portion of the body and has a short, cylindrical shape, and a third portion which integrally connects the first portion and the second portion. The first portion has a rectangular cross section. A sleeve is disposed in such a manner as to extend into the second portion and into the outlet pipe, and is joined to the second portion and to the outlet pipe, whereby the outlet pipe is connected to the outlet header.

However, a vehicle air conditioner which employs the laminated heat exchanger disclosed in the above publication as an evaporator may suffer occurrence of abnormal noise caused by flow of refrigerant from the evaporator at the time of start-up of the vehicle air conditioner. This abnormal noise is known to be noise having a frequency of 5,000 Hz to 6,000 Hz.

SUMMARY OF THE INVENTION

An object of the present invention is to solve the above-mentioned problem and to provide a laminated heat exchanger which can be free from occurrence of abnormal noise at the time of start-up of a vehicle air conditioner employing the same as an evaporator.

The inventors of the present invention carried out extensive studies to achieve the above object and, as a result, have found that the above-mentioned occurrence of abnormal noise depends on the shape and size of a refrigerant outlet and on the shape and equivalent diameter of the cross section of the body of an outlet header. On the basis of the findings, the present invention has been accomplished. The present invention comprises the following modes.

1) A laminated heat exchanger comprising a plurality of flat, hollow members arranged in a left-right direction in a laminated condition, each of the flat, hollow members comprising two vertically elongated metal plates having perimetric edge portions joined together, a bulging refrigerant flow tube portion being formed between the two metal plates, a bulging tank formation portion being formed continuously with each of opposite ends of the refrigerant flow tube portion, the tank formation portions of adjacent flat, hollow members being joined together, clearances between the refrigerant flow tube portions of adjacent flat, hollow members serving as air-passing clearances, a refrigerant outlet being formed in an outside wall of the tank formation portion of an endmost flat, hollow member located at one end in the left-right direction, an outlet header being fixed to an outer surface of the outside wall of the tank formation portion of the endmost flat, hollow member, the outlet header comprising a tubular body extending in a front-rear direction and having opposite end openings and a closing member for closing one of the end openings of the body, a refrigerant passage hole communicating with the refrigerant outlet being formed in a side wall of the body of the outlet header, and an outlet pipe having a circular cross section being connected to an open end portion of the body of the outlet header, wherein:

the refrigerant outlet is formed into a circular shape, and an inside diameter of the refrigerant outlet is 90% to 110% that of the outlet pipe excluding a worked distal end portion; the body of the outlet header comprises a first portion which is located on a side toward the closing member and in which the refrigerant passage hole is formed, a second portion which is the open end portion thereof and has a short, cylindrical shape and into which an end portion of the outlet pipe is inserted, and a third portion which integrally connects the first portion and the second portion; the first portion has a flat wall portion along the outer surface of the outside wall of the tank formation portion of the endmost flat, hollow member, and two fragmentary, cylindrical wall portions which are continuous with respective upper and lower edges of the flat wall portion via respective connection portions; a radius of curvature of an inner circumferential surface of the fragmentary, cylindrical wall portion is 35% to 50% a height of an interior space of the first portion; and an equivalent diameter of a cross section of the interior space of the first portion is 90% to 110% an inside diameter of the outlet pipe excluding the worked distal end portion.

The above-mentioned equivalent diameter is known to be expressed as $d=4A/L$, where A is the cross-sectional area of the interior space (flow path) of the first portion, and L is the wetted perimeter; i.e., the length of a perimetric wall in contact with fluid as viewed on the cross section of the interior space of the first portion.

2) A laminated heat exchanger according to par. 1), wherein an outwardly projecting flange is formed around the refrigerant outlet of the outside wall of the tank formation portion of the endmost flat, hollow member, and, while the flange is inserted into the refrigerant passage hole of the outlet header, the flat wall portion of the body of the outlet header is joined to the endmost flat, hollow member.

3) A laminated heat exchanger according to par. 1), wherein the end portion of the outlet pipe is inserted into the second portion of the outlet header without being reduced in diameter and is joined to the second portion.

4) A laminated heat exchanger according to par. 1), wherein the flat, hollow member comprises a hairpin refrigerant flow tube portion, which comprises two vertically extending, bulging linear portions spaced apart from each other in the front-rear direction and a bulging communication portion establishing communication between the two bulging linear portions at lower ends thereof, and two tank formation portions provided at an upper end portion of the flat, hollow member, the two tank formation portions being continuous with respective opposite ends of the hairpin refrigerant flow tube portion and being spaced apart from each other in the front-rear direction.

5) A laminated heat exchanger according to par. 4), wherein the flat, hollow members are grouped into a first group and a second group, the first group consisting of a plurality of the flat, hollow members in which refrigerant flows from a front tank formation portion to a rear tank formation portion via the hairpin refrigerant flow tube portion, the second group consisting of a plurality of the flat, hollow members in which refrigerant flows from the rear tank formation portion to the front tank formation portion via the hairpin refrigerant flow tube portion; the first and second groups are arranged alternately such that flat, hollow members of the first group are arranged at one end with respect to the left-right direction; and the refrigerant outlet is formed in the outside wall of the rear tank formation portion of an outermost flat, hollow member of the first group located at the one end.

6) A laminated heat exchanger according to par. 5), wherein a front-end opening of the body of the outlet header is closed by the closing member, and a front end portion of the body of the outlet header is located rearward of the front tank formation portions of the flat, hollow members of the first group.

7) A laminated heat exchanger according to par. 6), wherein an outer fin is disposed externally of the refrigerant flow tube portion of the outermost flat, hollow member of the first group located at the one end and is joined to the outermost flat, hollow member; a side plate is disposed externally of and joined to the outer fin; the side plate has a side plate body extending vertically and spaced apart from the outermost flat, hollow member, and projecting portions projecting inward with respect to the left-right direction and formed integrally with respective upper and lower end portions of the side plate body; the outer fin is disposed in the air-passing clearance between the outermost flat, hollow member and the side plate body and is joined to the outermost flat, hollow member and the side plate body; and a reinforcement portion is formed integrally with a front portion of the upper projecting portion of the side plate, projects upward, and is joined to an outer surface of the outside wall of the front tank formation portion of the outermost flat, hollow member.

8) A laminated heat exchanger according to par. 7), wherein an upwardly projecting portion is formed integrally with a rear portion of the upper projecting portion of the side plate, projects upward, and is joined to an outer surface of the outside wall of the rear tank formation portion of the outermost flat, hollow member, and a support portion for supporting a lower surface of the body of the outlet header is formed integrally with the upwardly projecting portion.

9) A laminated heat exchanger according to par. 5), wherein a refrigerant inlet is formed in the outside wall of the tank formation portion of a second endmost flat, hollow member located at the other end opposite the flat, hollow member in which the refrigerant outlet is formed; an inlet header is fixed to the outside wall of the tank formation portion of the second endmost flat, hollow member and comprises a tubular body extending in the front-rear direction and having opposite end openings, and a closing member for closing one of the end openings of the body; a refrigerant passage hole communicating with the refrigerant inlet is formed in a side wall of the inlet header; and an inlet pipe having a circular cross section is connected to an end portion of the inlet header.

10) A refrigeration cycle comprising a compressor, a condenser, and an evaporator, the evaporator comprising a laminated heat exchanger according to any one of pars. 1) to 9).

11) A vehicle having installed therein a refrigeration cycle according to par. 10) as a vehicle air conditioner.

According to the laminated heat exchanger of par. 1), the refrigerant outlet is formed into a circular shape, and an inside diameter of the refrigerant outlet is 90% to 110% that of the outlet pipe excluding a worked distal end portion; the body of the outlet header comprises a first portion which is located on a side toward the closing member and in which the refrigerant passage hole is formed, a second portion which is an open end portion thereof and has a short, cylindrical shape and into which an end portion of the outlet pipe is inserted, and a third portion which integrally connects the first portion and the second portion; the first portion has a flat wall portion along the outer surface of the outside wall of the tank formation portion of the endmost flat, hollow member, and two fragmentary, cylindrical wall portions which are continuous with respective upper and lower edges of the flat wall portion via respective connection portions; a radius of curvature of an inner circumferential surface of the fragmentary, cylindrical wall portion is 35% to 50% the height of the interior space of the first portion; and an equivalent diameter of a cross section of the interior space of the first portion is 90% to 110% the inside diameter of the outlet pipe excluding the worked distal end portion. Accordingly, when the laminated heat exchanger of par. 1) is used as, for example, an evaporator of a vehicle air conditioner, there can be suppressed occurrence of abnormal noise at the time of start-up.

According to the laminated heat exchanger of par. 6), the outlet header occupies a relatively small space.

According to the laminated heat exchanger of par. 7), the reinforcement portion of the side plate can reinforce the outside wall of the front tank formation portion of the outermost flat, hollow member of the first group. As compared with the case where a separate reinforcement member is prepared and joined to the outside wall of the front tank formation portion, manufacturing cost drops, and joining work is facilitated.

According to the laminated heat exchanger of par. 8), in a state before the outlet header is fixed to the flat, hollow member, the outlet header can be positioned while its rotation is prevented by means of the support portion of the side plate.

DESCRIPTION OF THE PREFERRED EMBODIMENT

An embodiment of the present invention will next be described in detail with reference to the drawings. The present embodiment is of a laminated heat exchanger according to the present invention which is applied to an evaporator of a vehicle air conditioner.

In the following description, the term "aluminum" encompasses aluminum alloys in addition to pure aluminum.

Figure 1:
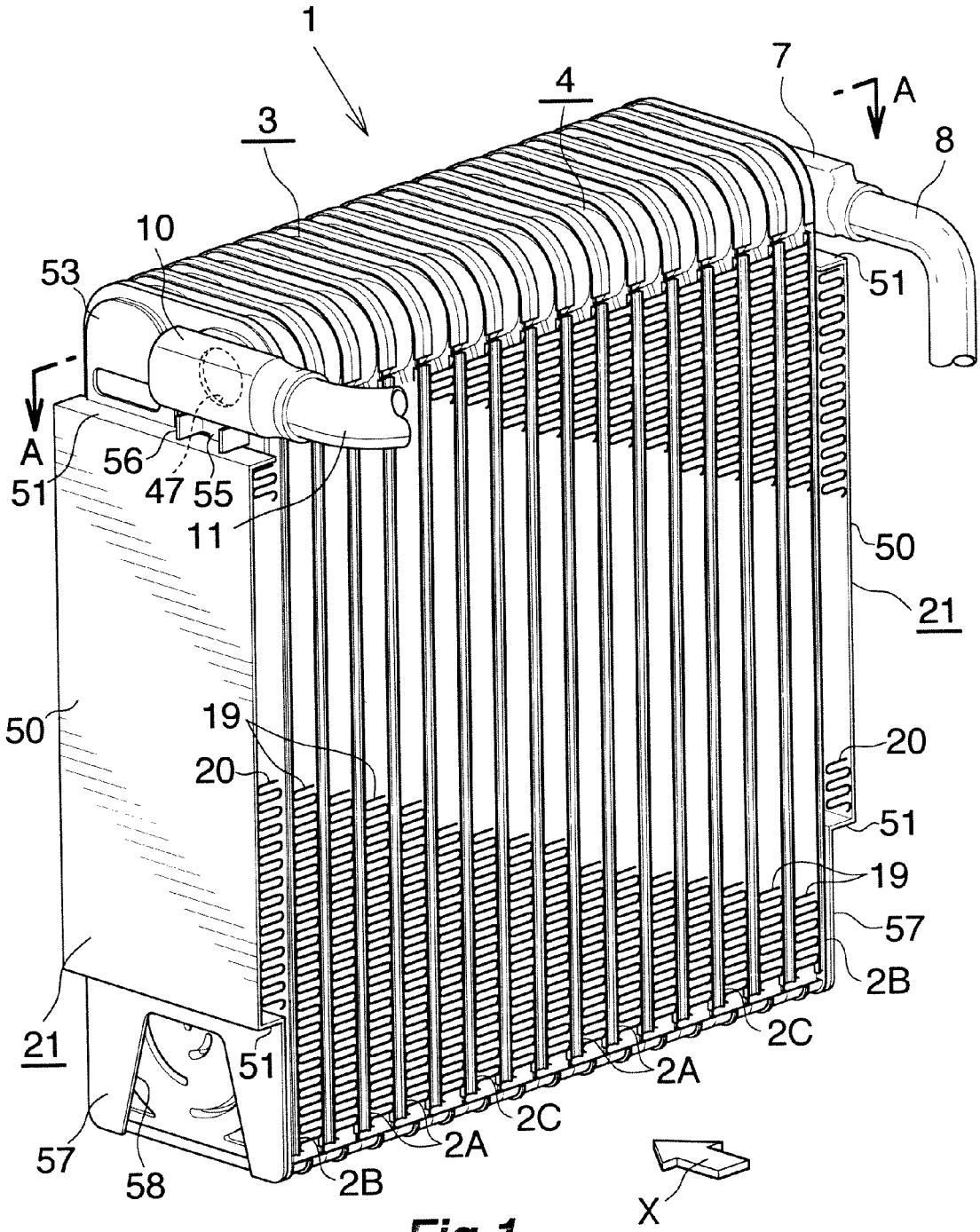
FIG. 1 is a perspective view showing the overall configuration of an evaporator to which a laminated heat exchanger of the present invention is applied.
Figure 2:
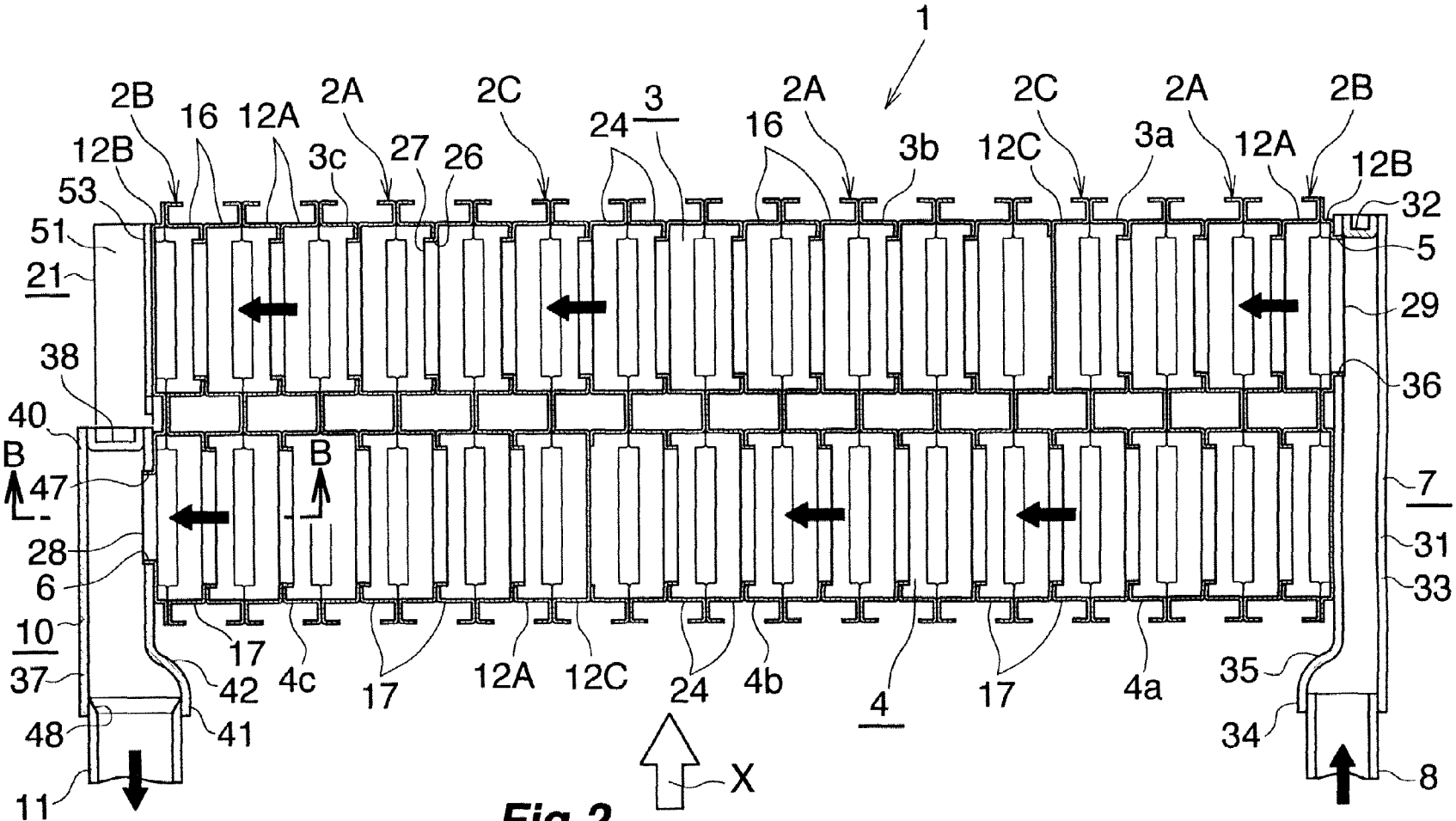
FIG. 2 is a sectional view taken along line A-A of FIG. 1.
Figure 9:
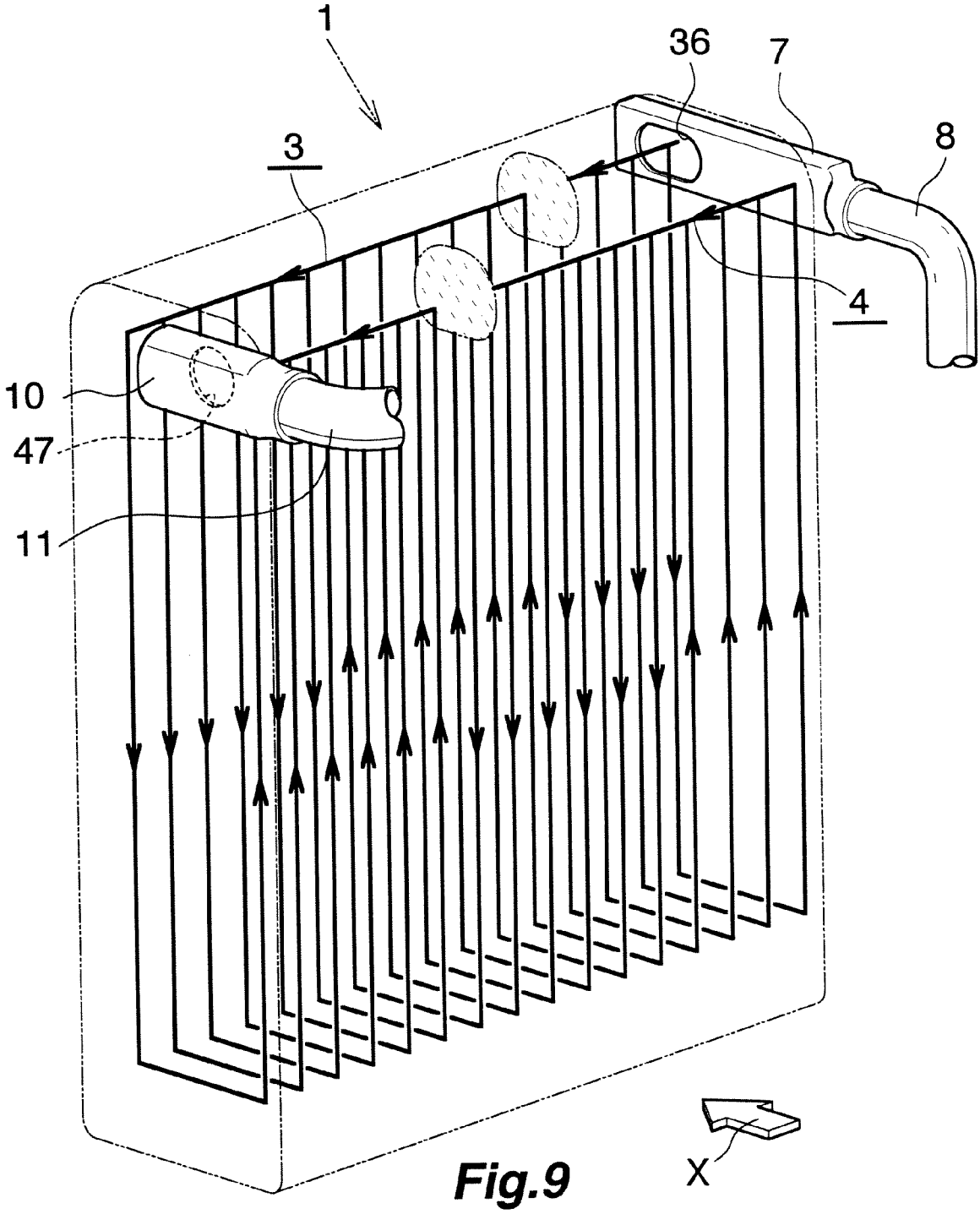
FIG. 9 is a diagram showing the flow of refrigerant in the evaporator of FIG. 1.

FIGS. 1 and 2 show the overall configuration of the evaporator of the present embodiment; FIGS. 3 to 8 show the configuration of essential portions of the evaporator; and FIG. 9 shows the flow of refrigerant in the evaporator.

Referring to FIGS. 1 and 2, an evaporator 1 is configured such that a plurality of flat, hollow members 2A, 2B, and 2C each having a vertically elongated rectangular shape are arranged in the left-right direction in a laminated condition and joined together while their widths extend in the front-rear direction (air flow direction). The evaporator 1 includes a front tank 3 extending in the left-right direction and a rear tank 4 located rearward of the front tank 3 and extending in the left-right direction. A refrigerant inlet 5 oblong in the front-rear direction is formed at the right end of the front tank 3, and a refrigerant outlet 6 is formed at the left end of the rear tank 4. An inlet header 7 is joined to the right ends of the front and rear tanks 3 and 4 in such a manner as to communicate with the refrigerant inlet 5. An inlet pipe 8 made of aluminum is connected to a rear end portion of the inlet header 7 for supplying refrigerant into the evaporator 1. An outlet header 10 is joined to the left end of the rear tank 4 in such a manner as to communicate with the refrigerant outlet 6. An outlet pipe 11 made of aluminum is connected to a rear end portion of the outlet header 10 for discharging refrigerant from the evaporator 1. The inlet pipe 8 and the outlet pipe 11 have a circular cross section, and unillustrated distal end portions thereof are worked for connection to another piece of equipment. The inlet and outlet pipes 8 and 11 excluding their worked distal end portions have a constant inside diameter.

As shown in FIGS. 1 to 4, each of the flat, hollow members 2A, 2B, and 2C includes two vertically extending rectangular aluminum plates 12A, 12B, or 12C (metal plates) whose perimetric edge portions are brazed together. Each of the aluminum plates 12A, 12B, and 12C is formed from an aluminum brazing sheet having a brazing material layer on each of opposite sides thereof. Each of the flat, hollow members 2A, 2B, and 2C includes a hairpin refrigerant flow tube portion 13 and two bulging tank formation portions 16 and 17. The hairpin refrigerant flow tube portion 13 includes two vertically extending, bulging linear portions 14 and a bulging communication portion 15 establishing communication between the two bulging linear portions 14 at lower ends thereof. The two bulging tank formation portions 16 and 17 are continuous with respective upper end portions of the two bulging linear portions 14 of the refrigerant flow tube portion 13. A corrugated inner fin 18 made of aluminum is disposed in the refrigerant flow tube portion 13 in such a manner as to extend across both bulging linear portions 14 and is brazed to both plates 12A, 12B, or 12C. Alternatively, two corrugated inner fins made of aluminum may be disposed separately in the respective bulging linear portions 14 of the refrigerant flow tube portion 13.

In the flat, hollow members 2A, 2B, and 2C, the height of the tank formation portions 16 and 17 in the left-right direction is greater than that of the refrigerant flow tube portion 13. The tank formation portions 16 and the tank formation portions 17 of the adjacent flat, hollow members 2A, 2B, and 2C are brazed together. The front tank formation portions 16 of the flat, hollow members 2A, 2B, and 2C form the front tank 3; similarly, the rear tank formation portions 17 form the rear tank 4. Clearances between the refrigerant flow tube portions 13 of the adjacent flat, hollow members 2A, 2B, and 2C serve as air-passing clearances. Corrugated outer fins 19 made of aluminum are disposed in the respective air-passing clearances and are brazed to the corresponding flat, hollow members 2A, 2B, and 2C. Also, corrugated outer fins 20 made of aluminum are disposed externally of the refrigerant flow tube portions 13 of the left- and right-end flat, hollow members 2B, respectively, and brazed to the flat, hollow members 2B. Furthermore, side plates 21 made of aluminum are disposed externally of the opposite end outer fins 20, respectively, and brazed to the outer fins 20 and the flat, hollow members 2B. The refrigerant flow tube portions 13 and the outer fins 19 and 20 constitute a heat exchange core section.

Figure 3:
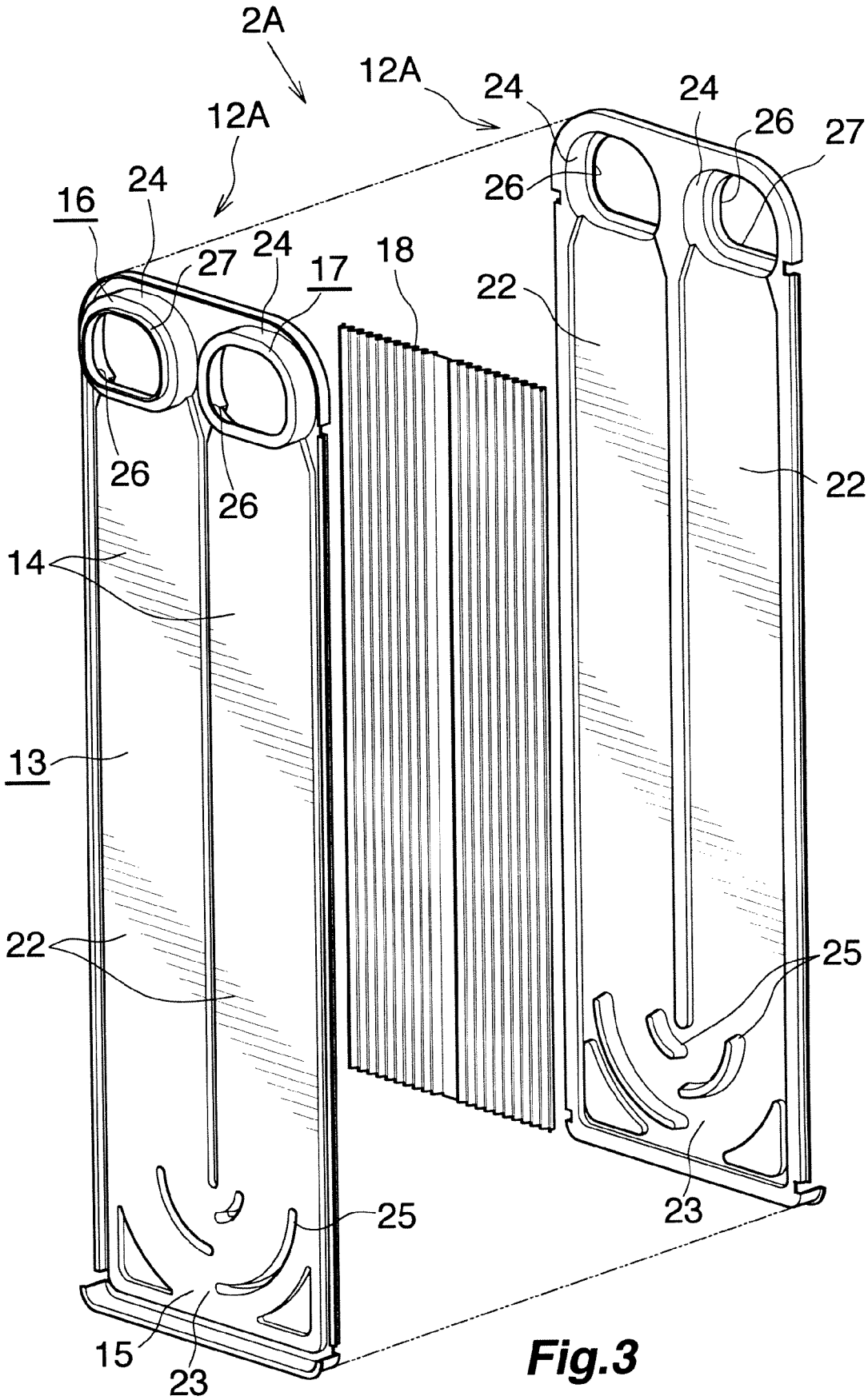
FIG. 3 is an exploded perspective view showing a first flat, hollow member used in the evaporator of FIG. 1.

FIG. 3 shows the configuration of the first flat, hollow member 2A, which is one of the flat, hollow members excluding the second flat, hollow members 2B disposed at the left and right ends, the third flat, hollow member 2C disposed a predetermined distance away from the right end, and the fourth flat, hollow member 2C biased slightly leftward from a central region with respect to the left-right direction. As shown in FIG. 3, the left plate 12A used to partially constitute the first flat, hollow member 2A includes two; i.e., front and rear, linear-portion-forming bulging portions 22 extending vertically and bulging leftward; a communication-portion-forming bulging portion 23 establishing communication between lower end portions of the linear-portion-forming bulging portions 22, bulging leftward, and having a bulging height equal to that of the linear-portion-forming bulging portions 22; and two tank-forming bulging portions 24 continuous with the respective upper ends of the linear-portion-forming bulging portions 22, bulging leftward, and having a bulging height greater than that of the linear-portion-forming and communication-portion-forming bulging portions 22 and 23. A plurality of inwardly projecting arcuate reinforcement ribs 25 are formed at intervals on the top wall of the communication-portion-forming bulging portion 23 by inwardly deforming corresponding portions of the top wall. The projecting height of the reinforcement ribs 25 is greater than that of the linear-portion-forming bulging portions 22. The top wall of each of the tank-forming bulging portions 24 is punched out to thereby form a through-hole 26. A leftward projecting flange 27 is integrally formed on the top wall of the front tank-forming bulging portion 24 around the through-hole 26. The right plate 12A used to partially constitute the first flat, hollow member 2A is a mirror image of the left plate 12A. Like features of the left and right plates 12A are denoted by like reference numerals. In the right plate 12A, the flange 27 is integrally formed on the top wall of the rear tank-forming bulging portion 24 around the through hole 26. The two plates 12A are assembled such that the openings of the linear-portion-forming, communication-portion-forming, and tank-forming bulging portions 22, 23, and 24 are opposed to each other while the inner fin 18 is sandwiched therebetween, followed by brazing. Thus is formed the first flat, hollow member 2A. In the two plates 12A used to partially constitute the first flat, hollow member 2A, the reinforcement ribs 25 of one plate 12A are shifted in position from the reinforcement ribs 25 of the other plate 12A and are brazed to the inner surface of the top wall of the communication-portion-forming bulging portion 23 of the other plate 12A.

The tank-forming portions 16 and the tank-forming portions 17 of the adjacent two first flat, hollow members 2A are brazed together such that the flange 27 of the rear tank-forming bulging portion 24 of the left-hand first flat, hollow member 2A is press-fitted into the through-hole 26 of the rear tank-forming bulging portion 24 of the right-hand first flat, hollow member 2A and such that the flange 27 of the front tank-forming bulging portion 24 of the right-hand first flat, hollow member 2A is press-fitted into the through-hole 26 of the front tank-forming bulging portion 24 of the left-hand first flat, hollow member 2A. With this brazing, the tank-forming portions 16 and the tank-forming portions 17 of the adjacent first flat, hollow members 2A are joined together in a communicating condition.

Figure 4:
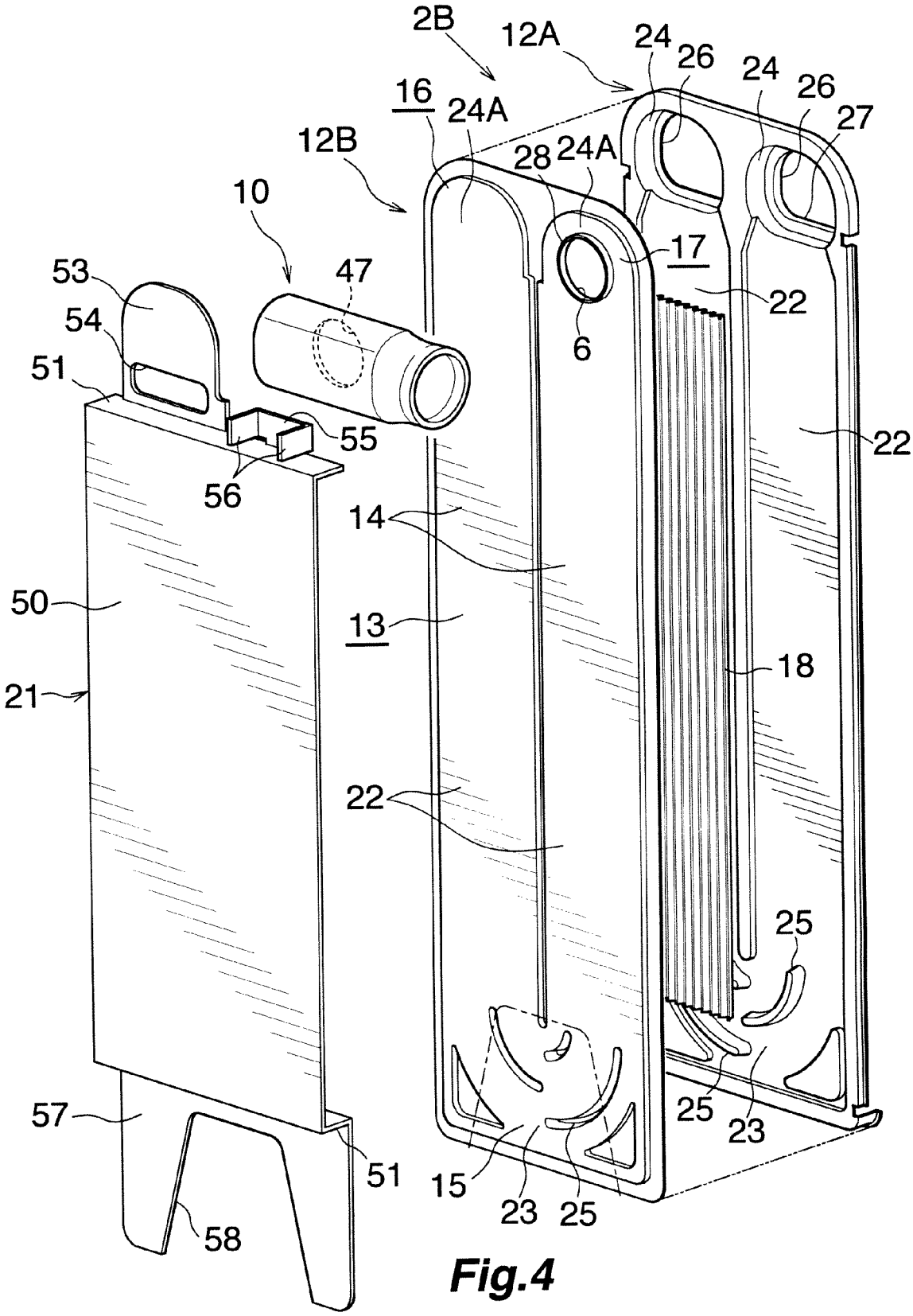
FIG. 4 is an exploded perspective view showing a second flat, hollow member and a side plate which are used in the evaporator of FIG. 1.
Figure 5:
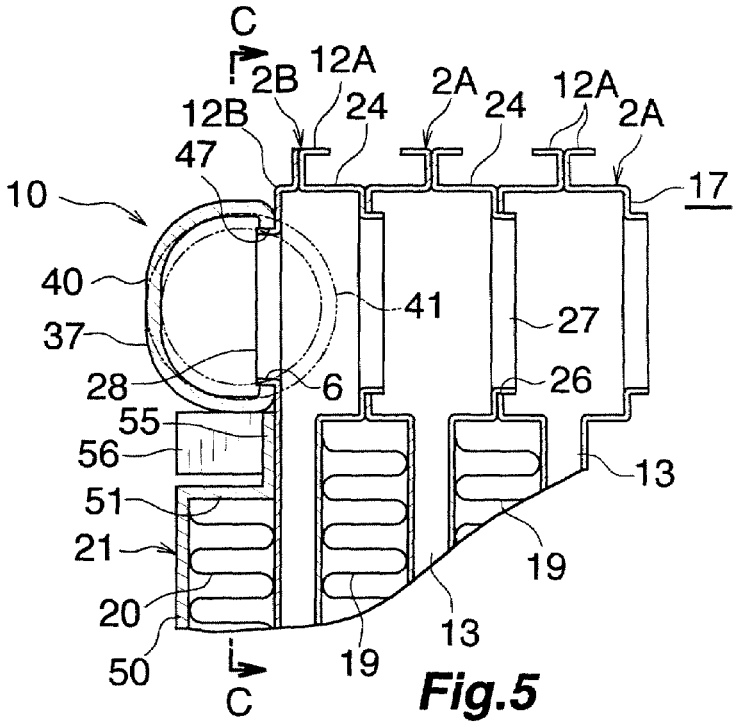
FIG. 5 is an enlarged fragmentary, sectional view taken along line B-B of FIG. 2.

As shown in FIG. 4, in the left plate 12B used to partially constitute the left-end second flat, hollow member 2B, the bulging height of two tank-forming bulging portions 24A is equal to that of the linear-portion-forming bulging portions 22. Also, in the left plate 12B, no through-hole is formed in the top wall of the front tank-forming bulging portion 24A, and the circular refrigerant outlet 6 is formed in the top wall of the rear tank-forming bulging portion 24A. A leftward projecting flange 28 is integrally formed on the top wall of the rear tank-forming bulging portion 24A around the refrigerant outlet 6. Other configurational features of the left-end second flat, hollow member 2B are identical with those of the first flat, hollow member 2A shown in FIG. 3. The tank formation portions 16 and 17 of the left-end second flat, hollow member 2B are joined, in a communicating condition, to the tank formation portions 16 and 17, respectively, of the right-hand adjacent first flat, hollow member 2A as in the case of joining of the adjacent first flat, hollow members 2A.

Figure 6:
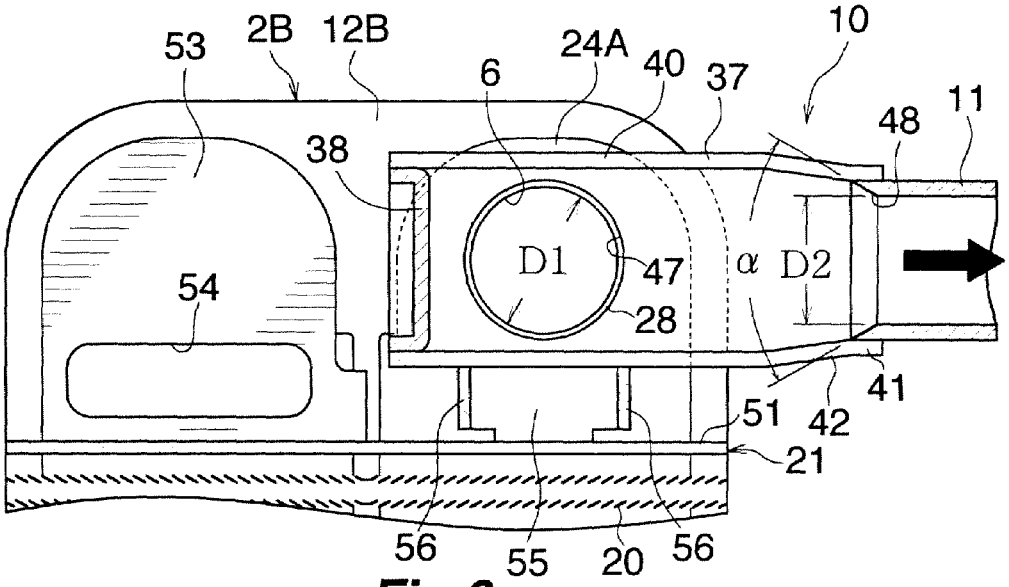
FIG. 6 is a sectional view taken along line C-C of FIG. 5.
Figure 7:
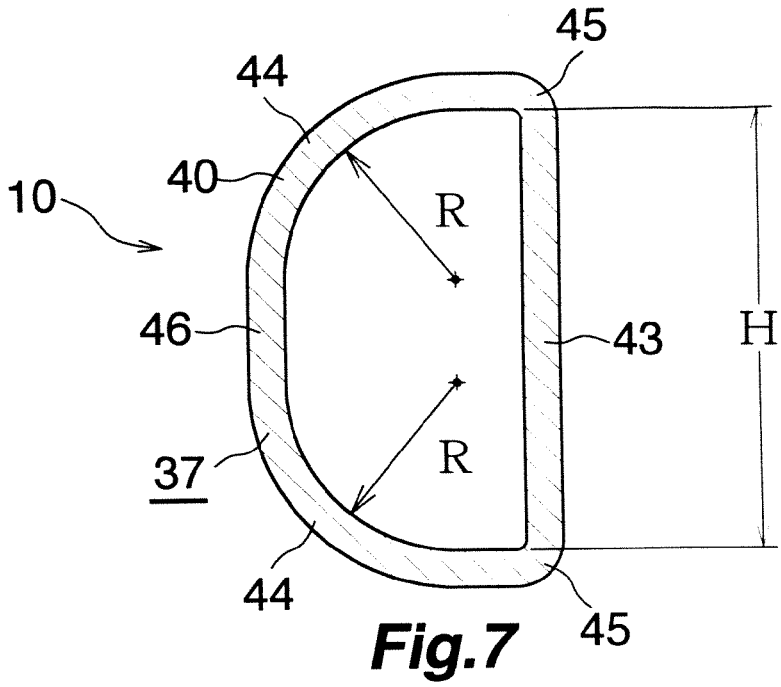
FIG. 7 is a cross-sectional view of a first portion of an outlet header.
Figure 8:
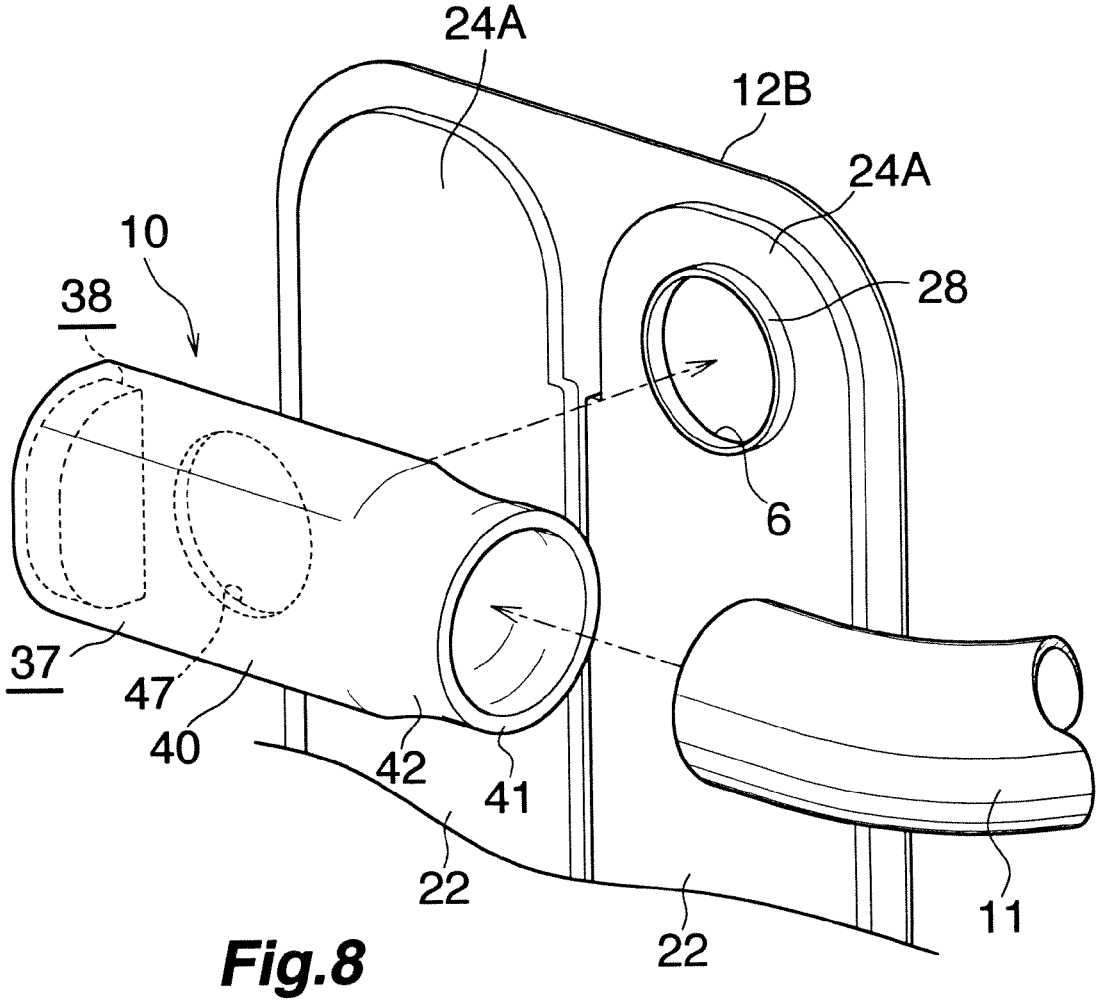
FIG. 8 is an exploded perspective view showing a portion of a left plate of a left-end flat, hollow member, and the outlet header.

As shown in FIG. 6, the inside diameter D1 of the refrigerant outlet 6 is 90% to 110% the inside diameter D2 of the outlet pipe 11 excluding a worked distal end portion. If the inside diameter D1 of the refrigerant outlet 6 is less than 90% or in excess of 110% the inside diameter D2 of the outlet pipe 11, while a refrigerant is flowing from the refrigerant outlet 6 into the outlet pipe 11, vortexes are likely to be generated due to expansion or reduction of a flow path and cause generation of abnormal noise. Also, the refrigerant becomes unlikely to flow smoothly from the rear tank 4 into the outlet header 10.

Although detailed illustrations are omitted, the flat, hollow member 2B disposed at the right end is substantially a mirror image of the second flat, hollow member 2B disposed at the left end and is identical in configuration with the second flat, hollow member 2B disposed at the left end except that: the refrigerant outlet 6 is not formed; the refrigerant inlet 5 is formed in the front tank-forming bulging portion 24A of the plate 12B; and a rightward projecting flange 29 is integrally formed on the top wall of the front tank-forming bulging portion 24A around the refrigerant inlet 5.

Although detailed illustrations are omitted, the third flat, hollow member 2C disposed a predetermined distance away from the right end is identical in configuration with the first flat, hollow member 2A except that no through-hole is formed in the top wall of the front tank-forming bulging portion 24 of the left plate 12C. The fourth flat, hollow member 2C biased slightly leftward from a central region with respect to the left-right direction is a mirror image of the third flat, hollow member 2C and is identical in configuration with the first flat, hollow member 2A except that no through-hole is formed in the top wall of the rear tank-forming bulging portion 24 of the right plate 12C.

In the third flat, hollow member 2C and in the flat, hollow members 2A and 2B located rightward of the third flat, hollow member 2C, the refrigerant flows from the front tank-forming portion 16 to the rear tank-forming portion 17 through the refrigerant flow tube portion 13; in the first flat, hollow members 2A sandwiched between the fourth flat, hollow member 2C and the third flat, hollow member 2C, the refrigerant flows from the rear tank-forming portion 17 to the front tank-forming portion 16 through the refrigerant flow tube portion 13; and in the fourth flat, hollow member 2C and in the flat, hollow members 2A and 2B located leftward of the fourth flat, hollow member 2C, the refrigerant flows from the front tank-forming portion 16 to the rear tank-forming portion 17 through the refrigerant flow tube portion 13. A first front-tank portion 3*a* is defined by a portion of the front tank 3 located rightward of the top wall of the tank-forming bulging portion 24 of the left plate 12C of the third flat, hollow member 2C; a second front-tank portion 3*b* is defined by a portion of the front tank 3 between the top wall of the tank-forming bulging portion 24 of the left plate 12C of the third flat, hollow member 2C and the top wall of the tank-forming bulging portion 24 of the right plate 12C of the fourth flat, hollow member 2C; and a third front-tank portion 3*c* is defined by a portion of the front tank 3 located leftward of the top wall of the tank-forming bulging portion 24 of the right plate 12C of the fourth flat, hollow member 2C. A first rear-tank portion 4*a* is defined by a portion of the rear tank 4 located rightward of the top wall of the tank-forming bulging portion 24 of the left plate 12C of the third flat, hollow member 2C; a second rear-tank portion 4*b* is defined by a portion of the rear tank 4 between the top wall of the tank-forming bulging portion 24 of the left plate 12C of the third flat, hollow member 2C and the top wall of the tank-forming bulging portion 24 of the right plate 12C of the fourth flat, hollow member 2C; and a third rear-tank portion 4*c* is defined by a portion of the rear tank 4 located leftward of the top wall of the tank-forming bulging portion 24 of the right plate 12C of the fourth flat, hollow member 2C.

The inlet header 7 includes a tubular body 31 made of aluminum, extending in the front-rear direction, and having opposite end openings, and a cover 32 (closing member) made of aluminum and brazed to a front end portion of the body 31 for closing the front end opening. The body 31 of the inlet header 7 includes a first portion 33 which is a portion remaining after excluding from the body 31 an open rear end portion, accounts for most of the body 31, and has a vertically tall, rectangular cross section; a second portion 34 which is a rear end portion of the body 31 and has a short, cylindrical shape and into which an end portion of the inlet pipe 8 is inserted; and a third portion 35 which integrally connects the first portion 33 and the second portion 34. The body 31 of the inlet header 7 is formed by deforming an end portion of a tubular member having opposite end openings and the same cross section as that of the first portion 33 into the third portion 35 and the second portion 34. A front end portion of the inlet header 7 is located slightly rearward of the front edge of the right-end second flat, hollow member 2B, and a rear end portion of the inlet header 7 projects rearward of the rear edge of the right-end second flat, hollow member 2B. A front end portion of the left wall of the first portion 33 of the body 31 of the inlet header 7 has a refrigerant passage hole 36 oblong in the front-rear direction and communicating with the refrigerant inlet 5 of the right-end second flat, hollow member 2B. While the flange 29 formed on the top wall of the front tank-forming bulging portion 24A of the right plate 12B of the right-end second flat, hollow member 2B is fitted into the refrigerant passage hole 36, the left wall of the first portion 33 of the body 31 of the inlet header 7 is brazed to the top walls of both tank-forming bulging portions 24A of the right plate 12B through utilization of a brazing material layer of the right plate 12B.

As shown in FIGS. 5 to 8, the outlet header 10 includes a tubular body 37 made of aluminum, extending in the front-rear direction, and having opposite end openings, and a cover 38 (closing member) made of aluminum and brazed to a front end portion of the body 37 for closing the front end opening. The body 37 of the outlet header 10 includes a first portion 40 which is a portion remaining after excluding from the body 37 an open rear end portion and accounts for most of the body 37; a second portion 41 which is a rear end portion of the body 37 and has a short, cylindrical shape and into which an end portion of the outlet pipe 11 is inserted; and a third portion 42 which integrally connects the first portion 40 and the second portion 41. The first portion 40 of the body 37 of the outlet header 10 includes a flat wall portion 43 standing vertically along the outer surface of the top wall (the outside wall of the tank formation portion 17) of the rear tank-forming bulging portion 24A of the left plate 12B of the left-end second flat, hollow member 2B; two fragmentary, cylindrical wall portions 44 which are continuous with respective upper and lower edges of the flat wall portion 43 via respective connection portions 45; and a vertical, flat connection wall portion 46, which is formed integrally with the ends of the fragmentary, cylindrical wall portions 44 to thereby make connection between the ends. The body 37 of the outlet header 10 is formed by deforming an end portion of a tubular member having opposite end openings and the same cross section as that of the first portion 40 into the third portion 42 and the second portion 41. A front end portion of the outlet header 10 is located rearward of the rear edge of the front tank formation portion 16 of the left-end second flat, hollow member 2B; a rear end portion of the outlet header 10 projects rearward of the rear edge of the left-end second flat, hollow member 2B; and, in the body 37, a rear end portion of the first portion 40, the third portion 42, and the second portion 41 are located rearward of the rear edge of the left-end second flat, hollow member 2B. The flat wall portion 43 of the first portion 40 of the body 37 of the outlet header 10 has a circular refrigerant passage hole 47 communicating with the refrigerant outlet 6 of the left-end second flat, hollow member 2B. While the flange 28 formed on the top wall of the rear tank-forming bulging portion 24A of the left plate 12B of the left-end second flat, hollow member 2B is fitted into the refrigerant passage hole 47, the flat wall portion 43 of the first portion 40 of the body 37 of the outlet header 10 is brazed to the outer surface of the top wall of the rear tank-forming bulging portion 24A of the left plate 12B through utilization of a brazing material layer of the left plate 12B. The outlet pipe 11 is joined to the outlet header 10 such that an end portion thereof is fitted into the second portion 41 of the outlet header 10.

The radius of curvature R of the inner circumferential surfaces of the two fragmentary, cylindrical wall portions 44 of the first portion 40 of the outlet header 10 is 35% to 50% the height H of the interior space of the first portion 40. If the radius of curvature R of the inner circumferential surfaces of the two fragmentary, cylindrical wall portions 44 is less than 35% the height H of the interior space of the first portion 40, the vertical width of the flat connection wall portion 46, which connects the two fragmentary, cylindrical wall portions 44, becomes 30% or more the height H of the interior space of the first portion 40. As a result, the refrigerant which flows into the outlet header 10 from the refrigerant outlet 6 impinges against the flat connection wall portion 46 and splashes, thereby disturbing the flow of refrigerant within the outlet header 10. If the radius of curvature R of the inner circumferential surfaces of the two fragmentary, cylindrical wall portions 44 is in excess of 50% the height H of the interior space of the first portion 40, the flat connection wall portion 46 fails to smoothly connect the two fragmentary, cylindrical wall portions 44. As a result, as in the case of a radius of curvature R of less than 35%, the flow of refrigerant within the outlet header 10 is disturbed. In either case, the refrigerant becomes unlikely to smoothly flow into the outlet header 10 from the rear tank 4. If the radius of curvature R of the inner circumferential surfaces of the two fragmentary, cylindrical wall portions 44 is 50% the height H of the first portion 40, needless to say, the two fragmentary, cylindrical wall portions 44 are directly connected, thereby collectively assuming a semicircular cross section. The equivalent diameter of the cross section of the interior space of the first portion 40 of the body 37 of the outlet header 10 is 90% to 110% the inside diameter D2 of the outlet pipe 11 excluding a worked distal end portion. If the equivalent diameter of the cross section of the first portion 40 is less than 90% or in excess of 110% the inside diameter D2 of the outlet pipe 11 excluding the worked distal end portion, while the refrigerant is flowing from the refrigerant outlet 6 into the outlet pipe 11, vortexes are likely to be generated due to expansion or reduction of a flow path and cause generation of abnormal noise. In either case, the refrigerant becomes unlikely to smoothly flow from the rear tank 4 to the outlet pipe 11 via the outlet header 10. The equivalent diameter d of the first portion 40 is expressed as $d=4A/L$, where A is the cross-sectional area of the interior space (flow path) of the first portion 40, and L is the wetted perimeter; i.e., the length of a perimetric wall in contact with fluid as viewed on the cross section of the interior space of the first portion 40.

The outlet pipe 11 is joined to the body 37 of the outlet header 10 such that a front end portion thereof is fitted into the second portion 41 of the body 37 of the outlet header 10. The front end of the outlet pipe 11 inserted into the second portion 41 of the body 37 is chamfered, thereby forming a chamfered portion 48. A bevel angle a of the chamfered portion 48 is preferably 100 degrees or less, more preferably 50 degrees to 70 degrees. The optimum bevel angle $\alpha$ of the chamfered portion 48 is 60 degrees.

As shown in detail in FIG. 4, each of the side plates 21 has a side plate body 50 spaced apart from the second flat, hollow member 2B and extending vertically over a distance from upper end portions to lower end portions of the two bulging linear portions 14 of the refrigerant flow tube portion 13 of the second flat, hollow member 2B, and projecting portions 51 projecting inward with respect to the left-right direction and formed integrally with respective upper and lower end portions of the side plate body 50. The clearance between the second flat, hollow member 2B and the side plate body 50 serves as an air-passing clearance. The corrugated outer fin 20 is disposed in this air-passing clearance and is brazed to the second flat, hollow member 2B and the side plate body 50.

A plate-like reinforcement portion 53 is formed integrally with a front portion of the projecting end of the upper projecting portion 51 of the left side plate 21; projects upward; is brazed to the outer surface of the top wall of the front tank formation portion 16 of the left-end second flat, hollow member 2B; and reinforces the top wall of the front tank-forming bulging portion 24A; i.e., the top wall of the front tank formation portion 16, of the left plate 12B of the left-end second flat, hollow member 2B. A through-hole 54 is formed in a lower end portion of the reinforcement portion 53 for preventing stagnation of water in a space formed between the reinforcement portion 53 and the outer surface of the front tank formation portion 16 of the left-end second flat, hollow member 2B. If water stagnates in the space between the reinforcement portion 53 and the outer surface of the front tank formation portion 16 of the left-end second flat, hollow member 2B, the stagnant water may freeze.

A plate-like upwardly projecting portion 55 elongated in the front-rear direction is formed integrally with a rear portion of the projecting end of the upper projecting portion 51 of the left side plate 21 and is brazed to the outer surface of the top wall of the rear tank formation portion 17 of the left-end second flat, hollow member 2B at a portion below the refrigerant outlet 6. A pair of; i.e., front and rear, support portions 56 projecting leftward are formed integrally with respective front and rear ends of the plate-like upwardly projecting portion 55 for supporting the first portion 40 of the body 37 of the outlet header 10. In a state before brazing, the support portions 56 prevent rotation of the outlet header 10 about an axis passing through the center of the refrigerant outlet 6 and extending in the left-right direction, thereby positioning the outlet header 10. In other words, since the refrigerant outlet 6 and the refrigerant passage hole 47 are circular, in a pre-brazing state with the flange 28 fitted into the refrigerant passage hole 47, the outlet header 10 may rotate about the axis passing through the center of the refrigerant outlet 6 and extending in the left-right direction. However, the support portions 56 can prevent this rotation.

Plate-like downward projecting portions 57 are formed integrally with the respective projecting ends of the lower projecting portions 51 of the opposite side plates 21 and are surface-brazed, in a partially overlapping condition, to the respective outer surfaces of the top walls of the communication-portion-forming bulging portions 23 of the outside plates 12B of the left- and right-end second flat, hollow members 2B. A cutout 58 is formed in each of the plate-like downward projecting portions 57 in such a manner as to extend from the lower edge of the plate-like downward projecting portion 57. The cutout 58 allows exposure, to the outside, of a lower end portion of a recess formed between the front and rear bulging linear portions 14 of the outside plate 12B of each of the left- and right-end second flat, hollow members 2B as well as at least portions of recesses associated with the ribs 25, thereby preventing stagnation of water in spaces formed between these recesses and the downward projecting portions 57 of the side plates 21.

In manufacture of the evaporator (1), component members thereof excluding the inlet pipe 8 and the outlet pipe 11 are assembled and tentatively fixed together, and the assembled component members are brazed together; subsequently, the inlet pipe 8 is joined to the inlet header 7, and the outlet pipe 11 is joined to the outlet header 10.

The evaporator 1 is accommodated in a casing disposed within a compartment of a vehicle; for example, an automobile, and, together with a compressor and a condenser, constitutes a refrigeration cycle, which is used as a vehicle air conditioner.

In the evaporator 1 described above, as shown in FIG. 9, a two-phase refrigerant of vapor-liquid phase having passed through a compressor, a condenser, and an expansion valve (pressure-reducing means) flows into the inlet header 7 from the inlet pipe 8 and enters the first front-tank portion 3*a* of the front tank 3 through the refrigerant passage hole 36 and the refrigerant inlet 5. As the refrigerant having entered the first front-tank portion 3*a* flows leftward through the first front-tank portion 3*a*, the refrigerant dividedly flows into the refrigerant flow tube portions 13 continuous with the first front-tank portion 3*a;* flows through the refrigerant flow tube portions 13; enters the first rear-tank portion 4*a;* joiningly flows leftward through the first rear-tank portion 4*a;* and enters the second rear-tank portion 4*b*. As the refrigerant having entered the second rear-tank portion 4*b* flows leftward through the second rear-tank portion 4*b*, the refrigerant dividedly flows into the refrigerant flow tube portions 13 continuous with the second rear-tank portion 4*b;* flows through the refrigerant flow tube portions 13; enters the second front-tank portion 3*b;* joiningly flows leftward through the second front-tank portion 3*b;* and enters the third rear-tank portion 3*c*. As the refrigerant having entered the third front-tank portion 3*c* flows leftward through the third front-tank portion 3*c*, the refrigerant dividedly flows into the refrigerant flow tube portions 13 continuous with the third front-tank portion 3*c;* flows through the refrigerant flow tube portions 13; enters the third rear-tank portion 4*c*. The refrigerant having entered the third rear-tank portion 4*c* flows leftward through the third rear-tank portion 4*c;* flows into the outlet header 10 through the refrigerant outlet 6 and the refrigerant passage hole 47; flows rearward through the outlet header 10; and flows out into the outlet pipe 11. While flowing through the refrigerant flow tube portions 13 of the flat, hollow members 2A, 2B, and 2C, the refrigerant is subjected to heat exchange with the air flowing through the air-passing clearances in the direction of arrow X shown in FIGS. 1, 2 and 9 and flows out from the evaporator 1 in a vapor phase.

The relationship between the inside diameter D1 of the refrigerant outlet 6 and the inside diameter D2 of the outlet pipe 11 excluding a worked distal end portion, the relationship between the radius of curvature R of the inner circumferential surface of the fragmentary, cylindrical wall portion 44 of the first portion 40 of the outlet header 10 and the height H of the interior space of the first portion 40, and the relationship between the equivalent diameter of the cross section of the first portion 40 of the body 37 of the outlet header 10 and the inside diameter D2 of the outlet pipe 11 excluding a worked distal end portion are as described above. Thus, the refrigerant flows smoothly into the outlet pipe 11 from the third rear-tank portion 4*c* of the rear tank 4 via the refrigerant outlet 6, the refrigerant passage hole 47, and the outlet header 10, thereby suppressing generation of abnormal noise even at the time of start-up.

Next will be described an example experiment which has been carried out by use of the above-described evaporator 1, as well as a comparative example experiment.

EXAMPLE EXPERIMENT

The evaporator 1 of the above-described embodiment had the following dimensions: inside diameter D1 of the refrigerant outlet 6: 13.3 mm; inside diameter D2 of the outlet pipe 11 excluding a worked distal end portion: 13.5 mm; radius of curvature R of the inner circumferential surface of the fragmentary, cylindrical wall portion 44 of the first portion 40 of the outlet header 10: 8 mm; height H of the interior space of the first portion 40: 19.5 mm; and equivalent diameter of the cross section of the inside space of the first portion 40 of the body 37 of the outlet header 10: 12.9 mm.

Figure 10:
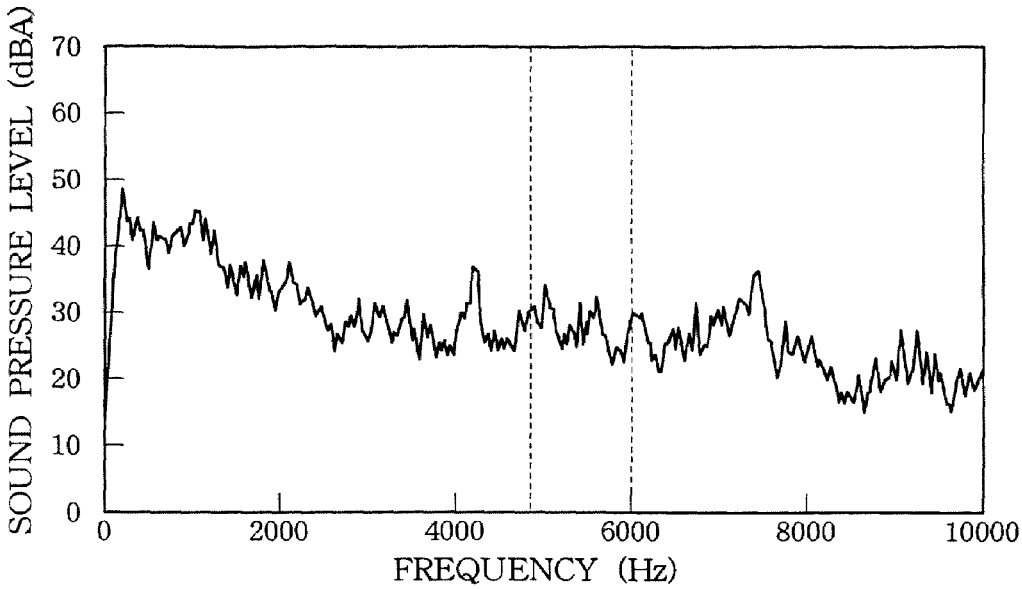
FIG. 10 is a graph showing the results of an example experiment.

The relationship between the frequency of sound and the sound pressure level was obtained when the vehicle air conditioner started to operate under the following conditions: ambient temperature of the evaporator 1: 30° C.; ambient humidity of the evaporator 1: 40% RH; air flow rate of the evaporator 1: 200 $m^3$/h; and rotational speed of compressor: 2,500 rpm. FIG. 10 shows the results of the Example Experiment.

COMPARATIVE EXAMPLE EXPERIMENT

The Comparative Example Experiment used an evaporator configured in a manner similar to that of the evaporator 1 of the above-described embodiment except that the refrigerant outlet assumed a shape oblong in the front-rear direction and that the first portion of the outlet header had a vertically tall, rectangular cross section. The evaporator had the following dimensions: equivalent diameter of the refrigerant outlet: 10.4 mm; inside diameter of the outlet pipe excluding a worked distal end portion: 13.5 mm; and equivalent diameter of the cross section of the inside space of the first portion of the body of the outlet header: 9.8 mm.

Figure 11:
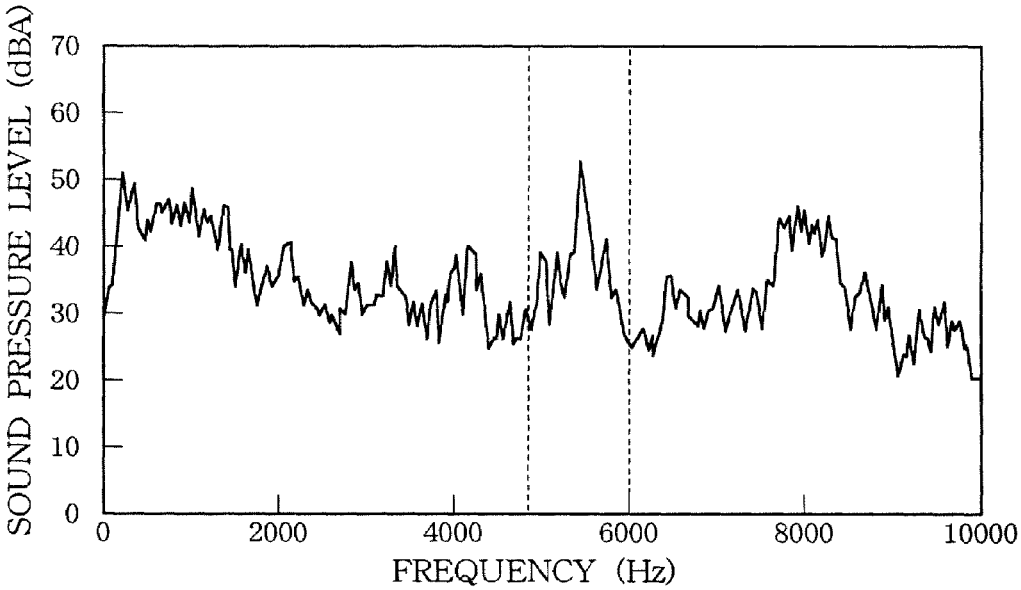
FIG. 11 is a graph showing the results of a comparative example experiment.

The relationship between the frequency of sound and the sound pressure level was obtained when the vehicle air conditioner started to operate under the same conditions as those of the above-mentioned Example Experiment. FIG. 11 shows the results of the Comparative Example Experiment.

As is apparent from the results shown in FIGS. 10 and 11, in the evaporator used in the Comparative Example Experiment, a sound having a frequency of 5,000 Hz to 6,000 Hz, which is most offensive to the ears, shows the highest sound level. By contrast, in the evaporator 1 used in the Example Experiment, the sound pressure level is considerably lowered for a sound having a frequency of 5,000 Hz to 6,000 Hz, which is most offensive to the ears.

What is claimed is:

1. A laminated heat exchanger comprising a plurality of flat, hollow members arranged in a left-right direction in a laminated condition, each of the flat, hollow members comprising two vertically elongated metal plates having perimetric edge portions joined together, a bulging refrigerant flow tube portion being formed between the two metal plates, a bulging tank formation portion being formed continuously with each of opposite ends of the refrigerant flow tube portion, the tank formation portions of adjacent flat, hollow members being joined together, clearances between the refrigerant flow tube portions of adjacent flat, hollow members serving as air-passing clearances, a refrigerant outlet being formed in an outside wall of the tank formation portion of an endmost flat, hollow member located at one end in the left-right direction, an outlet header being fixed to an outer surface of the outside wall of the tank formation portion of the endmost flat, hollow member, the outlet header comprising a tubular body extending in a front-rear direction and having opposite end openings and a closing member for closing one of the end openings of the body, a refrigerant passage hole communicating with the refrigerant outlet being formed in a side wall of the body of the outlet header, and an outlet pipe having a circular cross section being connected to an open end portion of the body of the outlet header, wherein:

the refrigerant outlet is formed into a circular shape, and an inside diameter of the refrigerant outlet is 90% to 110% that of the outlet pipe excluding a worked distal end portion;

the body of the outlet header comprises a first portion which is located on a side toward the closing member and in which the refrigerant passage hole is formed, a second portion which is the open end portion thereof and has a short, cylindrical shape and into which an end portion of the outlet pipe is inserted, and a third portion which integrally connects the first portion and the second portion;

the first portion has a flat wall portion along the outer surface of the outside wall of the tank formation portion of the endmost flat, hollow member, and two fragmentary, cylindrical wall portions for reducing occurrence of abnormal noise and which are continuous with respective upper and lower edges of the flat wall portion via respective connection portions;

a radius of curvature of an inner circumferential surface of the fragmentary, cylindrical wall portion is 35% to 50% of a height of an interior space of the first portion;

an equivalent diameter of a cross section of the interior space of the first portion is 90% to 110% of an inside diameter of the outlet pipe excluding the worked distal end portion; and the end portion of the outlet pipe is inserted into the second portion of the outlet header without being reduced in diameter and is joined to the second portion, the front end of the outlet pipe inserted into the second portion is chamfered, thereby forming a chamfered portion, and a bevel angle of the chamfered portion is 100 degrees or less.

2. A laminated heat exchanger according to claim 1, wherein:

an outwardly projecting flange is formed around the refrigerant outlet of the outside wall of the tank formation portion of the endmost flat, hollow member; and while the flange is inserted into the refrigerant passage hole of the outlet header, the flat wall portion of the body of the outlet header is joined to the endmost flat, hollow member.

3. A laminated heat exchanger according to claim 1, wherein:

the flat, hollow member comprises a hairpin refrigerant flow tube portion, which comprises two vertically extending, bulging linear portions spaced apart from each other in the front-rear direction and a bulging communication portion establishing communication between the two bulging linear portions at lower ends thereof, and two tank formation portions provided at an upper end portion of the flat, hollow member, the two tank formation portions being continuous with respective opposite ends of the hairpin refrigerant flow tube portion and being spaced apart from each other in the front-rear direction.

4. A laminated heat exchanger according to claim 3, wherein:

the flat, hollow members are grouped into a first group and a second group, the first group consisting of a plurality of the flat, hollow members in which refrigerant flows from a front tank formation portion to a rear tank formation portion via the hairpin refrigerant flow tube portion, the second group consisting of a plurality of the flat, hollow members in which refrigerant flows from the rear tank formation portion to the front tank formation portion via the hairpin refrigerant flow tube portion;

the first and second groups are arranged alternately such that flat, hollow members of the first group are arranged at one end with respect to the left-right direction; and the refrigerant outlet is formed in the outside wall of the rear tank formation portion of an outermost flat, hollow member of the first group located at the one end.

5. A laminated heat exchanger according to claim 4, wherein:

a front-end opening of the body of the outlet header is closed by the closing member; and a front end portion of the body of the outlet header is located rearward of the front tank formation portions of the flat, hollow members of the first group.

6. A laminated heat exchanger according to claim 5, wherein:

an outer fin is disposed externally of the refrigerant flow tube portion of the outermost flat, hollow member of the first group located at the one end and is joined to the outermost flat, hollow member;

a side plate is disposed externally of and joined to the outer fin;

the side plate has a side plate body extending vertically and spaced apart from the outermost flat, hollow member, and projecting portions projecting inward with respect to the left-right direction and formed integrally with respective upper and lower end portions of the side plate body;

the outer fin is disposed in the air-passing clearance between the outermost flat, hollow member and the side plate body and is joined to the outermost flat, hollow member and the side plate body; and a reinforcement portion is formed integrally with a front portion of the upper projecting portion of the side plate, projects upward, and is joined to an outer surface of the outside wall of the front tank formation portion of the outermost flat, hollow member.

7. A laminated heat exchanger according to claim 6, wherein:

an upwardly projecting portion is formed integrally with a rear portion of the upper projecting portion of the side plate, projects upward, and is joined to an outer surface of the outside wall of the rear tank formation portion of the outermost flat, hollow member; and a support portion for supporting a lower surface of the body of the outlet header is formed integrally with the upwardly projecting portion.

8. A laminated heat exchanger according to claim 4, wherein:

a refrigerant inlet is formed in the outside wall of the tank formation portion of a second endmost flat, hollow member located at the other end opposite the flat, hollow member in which the refrigerant outlet is formed;

an inlet header is fixed to the outside wall of the tank formation portion of the second endmost flat, hollow member and comprises a tubular body extending in the front-rear direction and having opposite end openings, and a closing member for closing one of the end openings of the body;

a refrigerant passage hole communicating with the refrigerant inlet is formed in a side wall of the inlet header; and an inlet pipe having a circular cross section is connected to an end portion of the inlet header.

9. A refrigeration cycle comprising a compressor, a condenser, and an evaporator, the evaporator comprising a laminated heat exchanger according to any one of claims 1, 2 and 3 to 8.

10. A vehicle having installed therein a refrigeration cycle according to claim 9 as a vehicle air conditioner.

* * * * *